US010102796B2

(12) United States Patent
Chung

(10) Patent No.: US 10,102,796 B2
(45) Date of Patent: Oct. 16, 2018

(54) IMAGE STICKING AVOIDANCE IN ORGANIC LIGHT-EMITTING DIODE (OLED) DISPLAYS

(71) Applicant: Dell Products, L.P., Round Rock, TX (US)

(72) Inventor: Tze Fung Chung, Singapore (SG)

(73) Assignee: Dell Products, L.P., Round Rock, TX (US)

( * ) Notice: Subject to any disclaimer, the term of this patent is extended or adjusted under 35 U.S.C. 154(b) by 5 days.

(21) Appl. No.: 15/458,021

(22) Filed: Mar. 13, 2017

(65) Prior Publication Data

US 2018/0261151 A1 Sep. 13, 2018

(51) Int. Cl.

| | |
|---|---|
| ***G09G 3/32*** | (2016.01) |
| ***G09G 3/20*** | (2006.01) |
| ***G09G 3/3208*** | (2016.01) |

(52) U.S. Cl.

CPC ..... *G09G 3/3208* (2013.01); *G09G 3/2003* (2013.01); *G09G 2320/0257* (2013.01); *G09G 2320/046* (2013.01); *G09G 2320/0626* (2013.01); *G09G 2330/04* (2013.01); *G09G 2340/16* (2013.01); *G09G 2354/00* (2013.01)

(58) Field of Classification Search

CPC ..... G09G 3/3208; G09G 3/2003; G09G 2320/0257; G09G 2320/046; G09G 2320/0626; G09G 2330/04; G09G 2340/16; G09G 2354/00

See application file for complete search history.

(56) References Cited

U.S. PATENT DOCUMENTS

| | | | | |
|---|---|---|---|---|
| 2003/0090488 | A1* | 5/2003 | Yoo | G09G 3/2007 345/473 |
| 2005/0001829 | A1* | 1/2005 | Bu | G09G 3/3648 345/209 |
| 2009/0069056 | A1* | 3/2009 | Lee | G06F 1/3203 455/566 |
| 2009/0147132 | A1* | 6/2009 | Sato | G06T 3/4007 348/451 |
| 2014/0146066 | A1* | 5/2014 | Kang | G09G 3/3225 345/545 |
| 2014/0240305 | A1* | 8/2014 | Chae | G09G 3/3225 345/212 |

* cited by examiner

*Primary Examiner* — Stephen G Sherman
(74) *Attorney, Agent, or Firm* — Fogarty LLP

(57) ABSTRACT

Systems and methods for systems and methods for image sticking avoidance in Organic Light-Emitting Diode (OLED) displays. In an illustrative, non-limiting embodiment, an Information Handling System (IHS) may include an OLED screen and a controller coupled to the OLED screen, where the controller is configured to: generate at least one current histogram matrix for a current frame; compare the at least one current histogram matrix against at least one previous histogram matrix generated for a previous frame; and enter a screen protection mode of operation in response to the comparison indicating that the at least one current histogram matrix is different from the at least one previous histogram matrix by an amount equal to or smaller than a threshold.

18 Claims, 4 Drawing Sheets

IMAGE STICKING AVOIDANCE IN ORGANIC LIGHT-EMITTING DIODE (OLED) DISPLAYS

FIELD

This disclosure generally relates to Information Handling Systems (IHSs), and, more particularly, to systems and methods for image sticking avoidance in Organic Light-Emitting Diode (OLED) displays.

BACKGROUND

As the value and use of information continue to increase, individuals and businesses seek additional ways to process and store information. An option is an Information Handling System (IHS). An IHS generally processes, compiles, stores, and/or communicates information or data for business, personal, or other purposes.

Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use, such as financial transaction processing, airline reservations, enterprise data storage, global communications, etc.

In addition, IHSs may include a variety of hardware and software components that may be configured to process, store, and communicate information; and may include one or more computer systems, data storage systems, and/or networking systems.

In many implementations, IHSs may be coupled to (or may include) screens, displays, or monitors. A common type of monitor in use today is the Liquid Crystal Display (LCD).

As the inventor hereof has recognized, however, LCDs are being replaced by displays that employ Organic Light-Emitting Diode (OLED) technologies. And, as the inventor hereof has also recognized, a significant problem with OLED displays is "image sticking."

When a still or static image is displayed by an OLED for long periods of time, pixels within the screen become incapable of properly responding to visual changes requested or required by the IHS—in other words, once displayed for too long, the still or static image "sticks" to the OLED display and subsequent images are not displayed correctly. Moreover, unlike an LCD monitor, image sticking in an OLED display is generally non-recoverable, which can reduce the display's useful life.

To address these, and other concerns, the inventor hereof has developed systems and methods for image sticking avoidance in OLED displays.

SUMMARY

Embodiments of systems and methods for image sticking avoidance in Organic Light-Emitting Diode (OLED) displays are described. In an illustrative, non-limiting embodiment, an Information Handling System (IHS) may comprise: an OLED screen and a controller coupled to the OLED screen, where the controller is configured to: generate at least one current histogram matrix for a current frame; compare the at least one current histogram matrix against at least one previous histogram matrix generated for a previous frame; and enter a screen protection mode of operation in response to the comparison indicating that the at least one current histogram matrix is different from the at least one previous histogram matrix by an amount equal to or smaller than a threshold.

In some cases, at least one current histogram matrix may include: a first red sub-pixel histogram matrix, a first green sub-pixel histogram matrix, and a first blue sub-pixel histogram matrix, and/or at least one previous histogram matrix includes a second red sub-pixel histogram matrix, a second green sub-pixel histogram matrix, and a second blue sub-pixel histogram matrix. Each current and each previous histogram matrix may include, for each given color sub-pixel, a brightness level for the given color sub-pixel, and wherein each of the brightness levels is between 0 and 255.

The threshold amount may be selected based upon at least one of: a noise expected during a switch between the current frame and the previous frame, and a sensitivity of detection desired during the switch between the current frame and the previous frame.

The difference between the at least one current histogram matrix and the at least one previous histogram matrix may be maintained or decreased for a selected amount of time prior to the entering of the screen protection mode. For example, the screen protection mode may include: a uniform reduction in brightness of the screen for a first period of time, followed by a warning message displayed on the screen for a second period of time, followed by a turning of the screen black until user interaction with a user input device coupled to the IHS is detected.

In some implementations, the current frame and the previous frame may each consist of a subset of pixels smaller than a total number of pixels present in the OLED screen. For instance, the subset of pixels may exclude pixels located at a top portion of the OLED screen and pixels located at a bottom portion of the OLED screen. Additionally or alternatively, the subset of pixels may exclude an area of the OLED screen that is subject to change over time in the absence of any user interaction with any input device coupled to the IHS.

Additionally or alternatively, the subset of pixels may include a plurality of detection regions, each detection region including a plurality of neighboring pixels in the OLED screen. For example, the one or more of the plurality of detection regions may include a center of the OLED screen. Additionally or alternatively, one or more of the plurality detection regions may be selected by a user. Additionally or alternatively, one or more of the detection regions may be subject to the generating and comparing operations more often than another one of the detection regions.

In another illustrative, non-limiting embodiment, a method may implement one or more of the aforementioned operations. In yet another illustrative, non-limiting embodiment, a hardware memory device may have program instructions stored thereon that, upon execution by an IHS, cause the IHS to perform one or more of the aforementioned operations.

BRIEF DESCRIPTION OF THE DRAWINGS

The present invention(s) is/are illustrated by way of example and is/are not limited by the accompanying figures. Elements in the figures are illustrated for simplicity and clarity, and have not necessarily been drawn to scale.

DETAILED DESCRIPTION

In various embodiments, systems and methods described herein may employ techniques for avoiding, preventing, reducing, and/or delaying image sticking (IS) in Organic Light-Emitting Diode (OLED) displays. In many cases, these techniques may prevent or delay the onset of IS in an OLED monitor. As used herein, the term "OLED" refers to displays, monitors, screens, and/or panels having one or more flexible sheets of organic electroluminescent material.

Generally speaking, IS occurs in OLED because the monitor's brightness naturally degrades or diminishes over time, and also because the display's red (R), green (G), and blue (B) sub-pixels degrade at different rates. In order to prevent IS, it is necessary to avoid the prolonged display of static images on the screen.

Certain conventional OLED panels may have traditional, built-in mechanisms to avoid IS, such as, for example: pixel shifting, compensating for the degradation curve, and limiting the maximum OLED current. And, at the system level, another IS solution is to dim or off the monitor immediately when it is not being used. In contrast with the foregoing, however, various techniques described herein may automatically dim and turn off an OLED monitor by analyzing the actual screen content, for example, frame-by-frame. When there is no change to the screen for a pre-determined period of time, the monitor may enter a screen protection mode.

Figure 1:
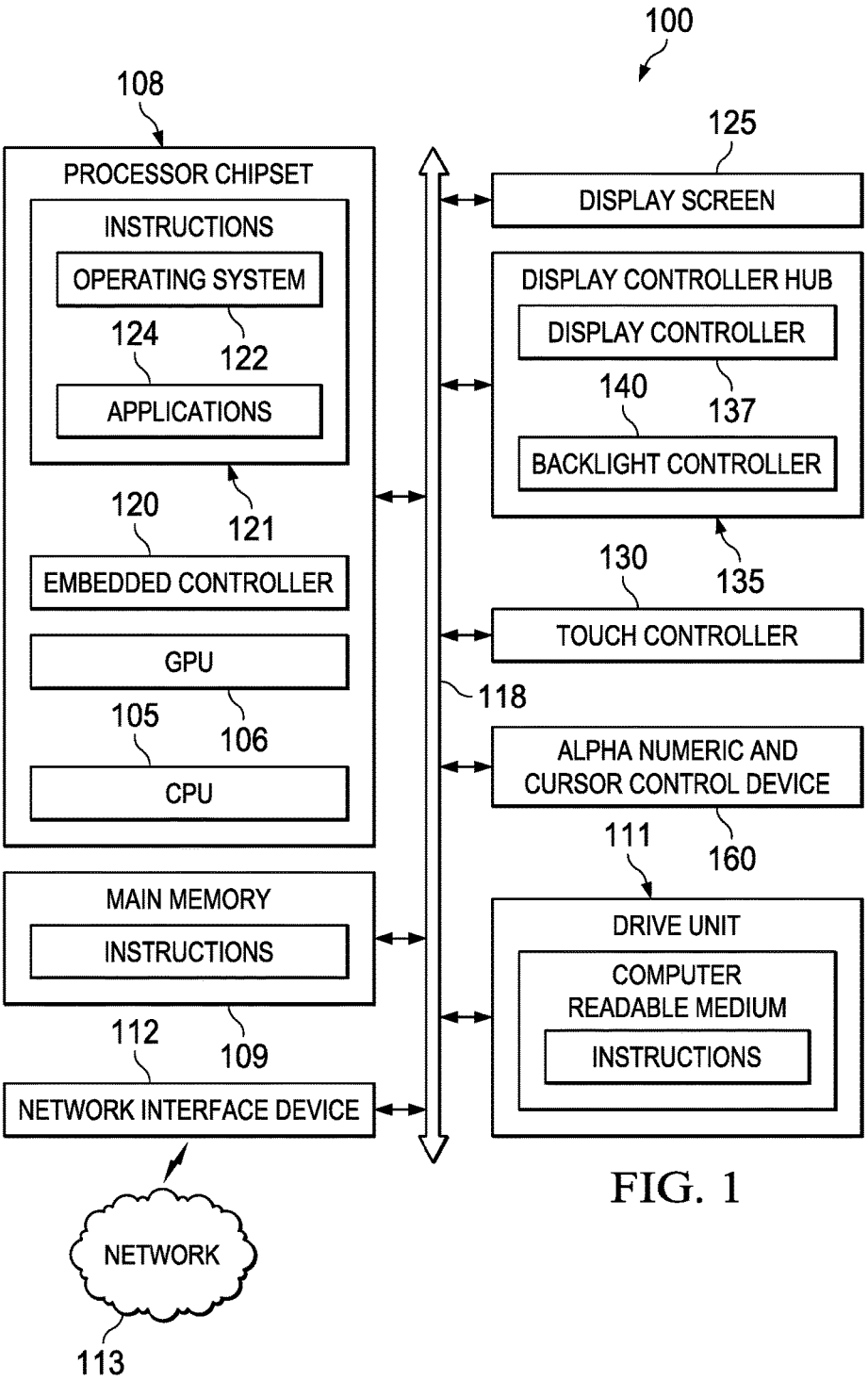
FIG. 1 is a block diagram of an example of an Information Handling System (IHS) configured according to some embodiments.

Turning now to FIG. 1, a diagram of Information Handling System (IHS) 100 configured to implement methods for image sticking avoidance in OLED displays is depicted. In some embodiments, IHS 100 may be coupled to display screen 125 (e.g., an OLED monitor) and/or to display controller hub 135 (e.g., a System-on-Chip or "SoC" within an OLED monitor). Additionally or alternatively, IHS 100 may itself be used as a component within display screen 125 and/or implemented as display controller hub 135. In either case, IHS 100 may include a set program instructions that can be executed to cause IHS 100 to perform one or more of the operations disclosed herein.

In various environments, IHS 100 may be implemented using electronic devices that provide voice, video or data communications. Further, while a single IHS 100 is illustrated, the term "system" shall also be taken to include any collection of systems or sub-systems that individually or jointly execute a set, or multiple sets, of instructions to perform one or more computer operations.

IHS 100 includes main memory 109, one or more processing resources such as a Central Processing Unit (CPU) 105 or hardware or software control logic, and operates to execute code. Additional components of IHS 100 may include one or more storage devices such as static memory or disk drives 111. These memory devices 109 and/or 111 can store code and data. In various embodiments, devices 109 and/or 111 may be implemented using any suitable memory technology, such as static RAM (SRAM), synchronous dynamic RAM (SDRAM), nonvolatile/Flash-type memory, or any other type of memory.

Storage device 111 may be an internal or external device coupled to IHS 100 via a local bus or port. For example, such a bus or port may include implementations of various version of the Universal Serial Bus (USB) protocol. Additionally or alternatively, storage device 111 may include a Common Internet File System (CIFS) and/or Network-Attached Storage (NAS).

Other components of IHS 100 may include one or more communications ports for communicating with external devices as well as various input and output (I/O) devices. I/O devices may include alphanumeric and cursor control devices 160 such as a keyboard, a touchpad, a mouse, one or more video display devices 125, display touchscreen(s) with touch controllers 130, etc. IHS 100 may also include one or more buses 118 operable to transmit communications between the various hardware components.

Again, IHS 100 may include one or more processing resources such as CPU 105, Graphics Processing Unit (GPU) 106 that may or may not be integrated with CPU 105, and related chipset(s) 108 or hardware or software control logic.

In various embodiments, IHS 100 may be a single-processor system including one CPU or a multi-processor system including two or more CPUs (e.g., two, four, eight, or any other suitable number). CPU(s) 105 may include any processor capable of executing program instructions. For example, in various embodiments, CPU(s) 105 may be general purpose or embedded processors implementing any of a variety of Instruction Set Architectures (ISAs), such as the x86, POWERPC®, ARM®, SPARC®, or MIPS® ISAs, or any other suitable ISA. In multi-processor systems, each of CPU(s) 105 may commonly, but not necessarily, implement the same ISA.

IHS 100 may include several sets of instructions 121 to be run by CPU 105, GPU 106, and/or any embedded controllers 120 on IHS 100. One such set of instructions includes Operating System (OS) 122 with an OS interface.

Examples of OSs 122 may include those used with typical mobile computing devices such as WINDOWS mobile OS from MICROSOFT CORPORATION and ANDROID OS from GOOGLE, INC. Additional sets of instructions in the form of multiple software applications 124 may be run by IHS 100. These applications 124 may enable multiple uses of IHS 100.

IHS 100 may operate as a standalone device or may be connected to other computer systems or peripheral devices. IHS 100 can represent a server device whose resources can be shared by multiple client devices, or it can represent an individual client device, such as an individual mobile personal computing system.

Network interface device 112 may include a wireless cellular or mobile networks (CDMA, TDMA, etc.), WIFI, WLAN, LAN, or similar network connection, enabling a user to communicate via a wired or wireless communications network 113, such as the Internet. IHS 100 may be configured with conventional web browser software. The web browser may include for example MICROSOFT's Internet Explorer web browser software, FIREFOX or similar such browsers to allow the user to interact with websites via network 113.

IHS 100 also includes one or more display devices 125 that may utilize LCD, OLED, or other thin film technologies. Each display device 125 may be capable of touch input via touch controller 130. Each display device 125 has a display controller hub 135. The display controller hub 135 may include control logic and software or access separate control logic and software. Components may include a display controller or driver 137 and a backlight controller 140 for LCD thin film display technologies or a brightness controller for OLED/AMOLED technologies.

One or more parts of the display controller hub 135 may be operated by or integrated with one or more graphics processing units (GPUs) 106 such as those that are part of the chipset 108. Display device 125 and one or more parts of display controller hub 135 may also be controlled by embedded controller 120 of chipset 108. Each GPU 106 and display controller/driver 137 is responsible for rendering graphics such as software application windows and virtual tools on display device 125.

In various embodiments, devices 109 and/or 111 may include one or more "file systems." As used herein, the term "file system" refers to systems and data structures that OS 122 uses to keep track of "files" on a given disk or storage partition; that is, the way the files are organized. Generally speaking, a file system may include one or more kernel-mode components that are executed as part of an OS (e.g., WINDOWS).

Figure 2:
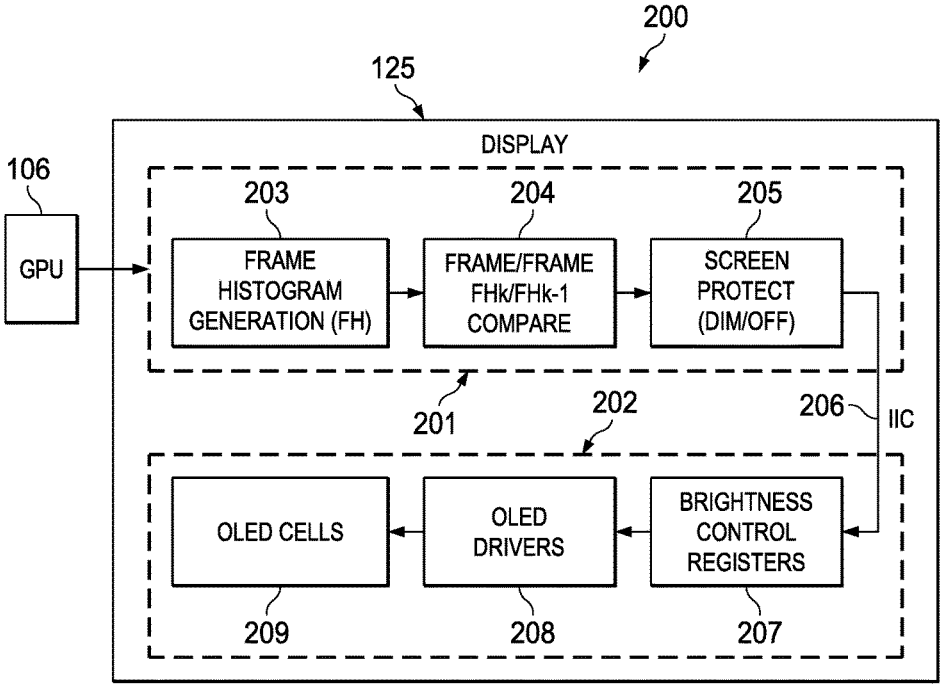
FIG. 2 is a block diagram of an example of a system for image sticking avoidance according to some embodiments.

FIG. 2 is a block diagram of an example of system 200 for image sticking avoidance. In some embodiments, system 200 includes GPU 106 coupled to display 125. Display 125 includes scalar board or engine 201 and panel or timing controller (T-con) 202.

Block 203 of scalar engine 201 generates a snapshot of each frame received from GPU 106, and it generates a frame histogram matrix (FH) for each such frame. The information collected in the histogram is a tally of the number of sub-pixel counts for each grey level in a frame. In some implementations, gray levels may range from 0 (black) to 255 (white).

At block 204, scalar engine 201 compares, frame-by-frame, the difference(s) between a current histogram matrix ($FH_k$) and a previous histogram matrix ($FH_{k-1}$). That is, in operation, block 203 generates a frame histogram matrix given by:

$$FH_k = \begin{pmatrix} FHR_k \\ FHG_k \\ FHB_k \end{pmatrix}$$

where $FH_k$ is the frame histogram matrix for frame k, and includes RGB sub-pixel histogram matrices $FHR_k$, $FHG_k$, and $FHB_k$, respectively. Accordingly, each frame histogram matrix $FH_k$ includes the following sub-matrices:

$$FHR_k=(NR_{L0,k}, NR_{L1,k} \ldots NR_{L255,k})$$

$$FHG_k=(NG_{L0,k}, NG_{L1,k} \ldots NG_{L255,k})$$

$$FHB_k=(NB_{L0,k}, NB_{L1,k} \ldots NB_{L255,k})$$

where $NR_{La,k}$ is the total number of red sub-pixels with brightness level a in frame k, $NG_{La,k}$ is the total number of green sub-pixels with brightness level a in frame k, and $NB_{La,k}$ is the total number of blue sub-pixels with brightness level a in frame k. As noted above, in some cases, brightness levels may range from 0 to 255.

At block 204, scalar engine 201 performs the following comparison:

$$X=f|(FH_k-FH_{k-1})|$$

The resultant X is a function of the absolute difference between frame histograms. Still at block 204, if $X>X^{th}$ (a selected threshold value), this indicates that there is movement on the screen, which signifies that the user is present and the monitor is in active use. If $X<X^{th}$, however, control passes to block 205 of scalar engine 205, which implements a screen protection algorithm such as shown in FIG. 3, for example.

In some implementations, the threshold value $X^{th}$ may be selected according to a tradeoff between harmless "visual noise" and detection sensitivity. As used herein, the term "visual noise" refers to a moving image or portion thereof that "moves" at a rate above a minimum acceptable rate within a frame, but such that the remainder of the frame continues to display a still image, thus resulting in image sticking for the remainder of the frame. It should be noted that, because block 204 is comparing statistical value(s), these operations may be performed in real-time or near real-time.

Figure 3:
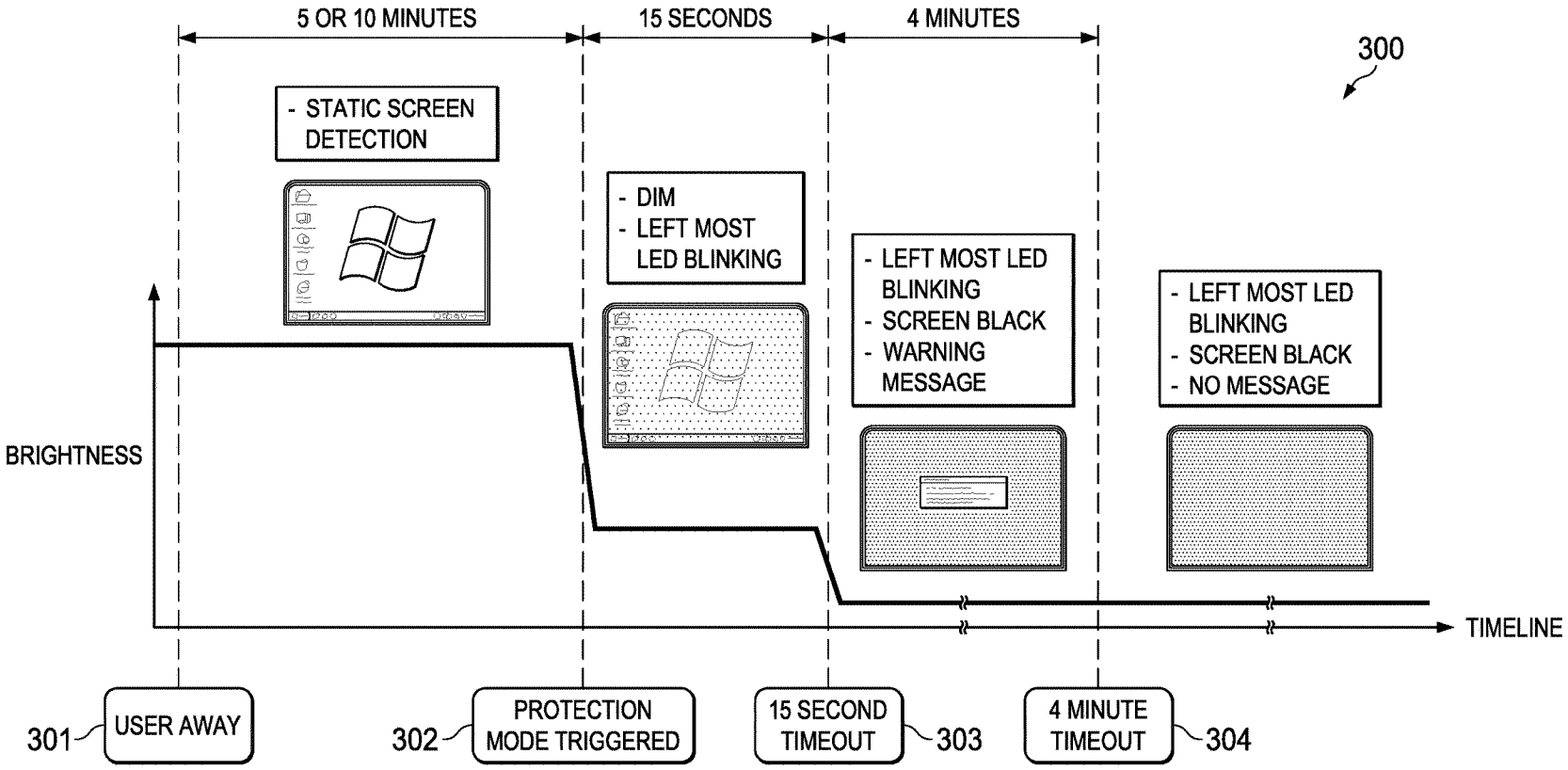
FIG. 3 is a timeline diagram of an example of a method for image sticking avoidance according to some embodiments.

Upon command from block 204 (e.g., when $X<X^{th}$), block 205 of scalar engine 201 executes the screen protection algorithm illustrated in FIG. 3. Particularly, block 205 determines whether to dim or turn off the screen, and populates brightness control registers 207 of T-con 202, for example, via an $I^2C$ (Inter-integrated circuit) interface or protocol 206, or the like. Brightness and control registers 207 are used by OLED drivers 208, which in turn produce an control voltages applied to OLED cells 209, each of which may include RGB sub-pixels, to thereby produce image for the user.

FIG. 3 is a timeline diagram of an example of a method for image sticking avoidance according to some embodiments. At time 301, a user walks away from his or her computer, and a static screen detection method may be performed. When no screen content changes are detected for a period of time (e.g., 5 or 10 minutes, selectable), the screen protection mode is triggered at time 302. For example, brightness may be reduced by half and/or a front LED may blink, indicating that the monitor is entering a protection mode.

After a first timeout period 303 (e.g., 15 seconds, selectable), the video output from GPU 106 and/or the display's input may be turned off while an on-screen message informs the user that the monitor is operating in screen protection mode. After a second timeout period 304 (e.g., 4 min, selectable), the on-screen message disappears and the entire screen is turned black. At any time during this sequence, the screen may recover (and exit protection mode) when screen content change is detected (e.g., by moving the mouse cursor, or by pressing any front buttons).

Figure 4:
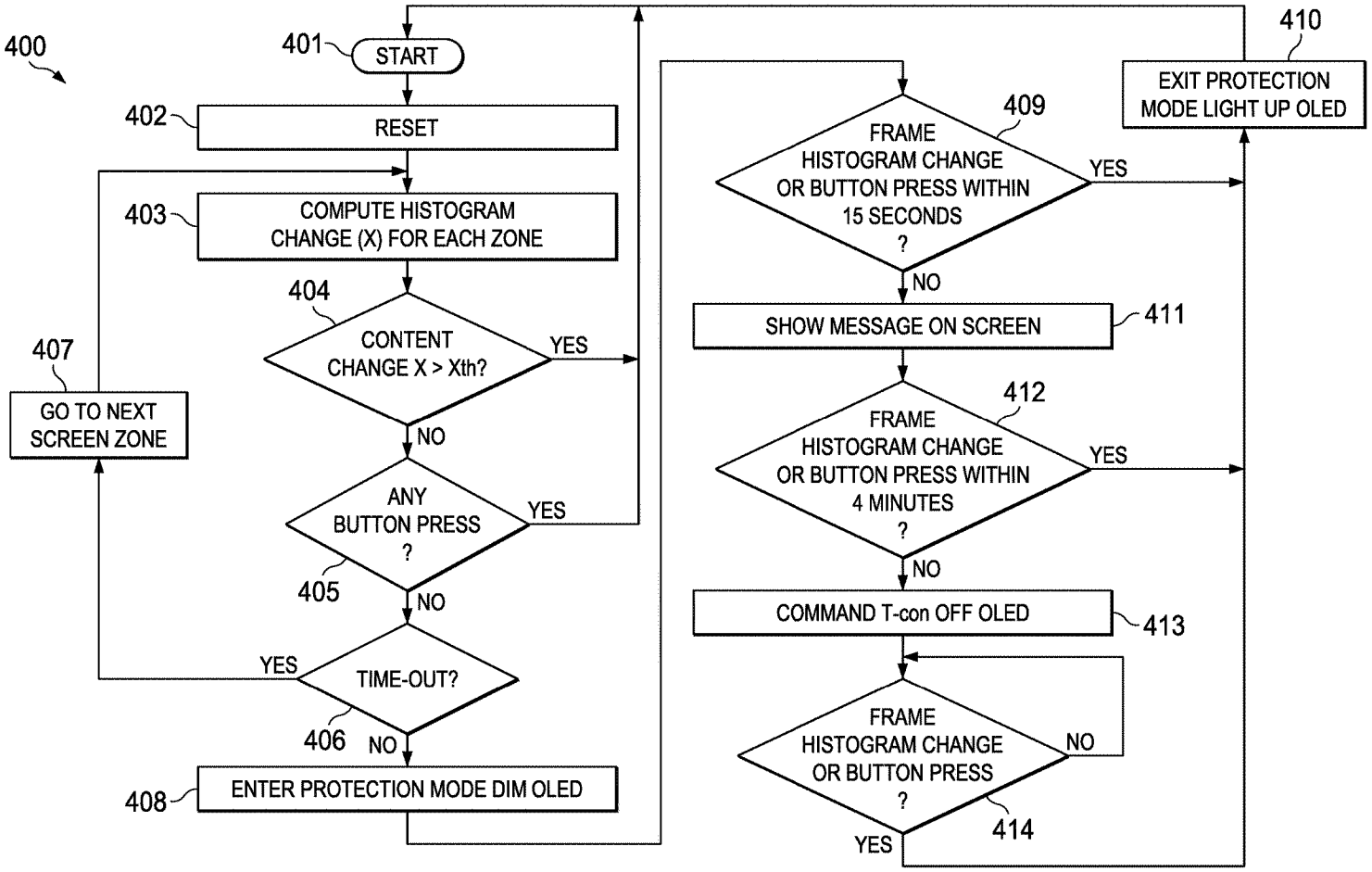
FIG. 4 is a flowchart of an example of a method for image sticking avoidance according to some embodiments.

FIG. 4 is a flowchart of an example of a method for image sticking avoidance according to some embodiments. At block 401, method 400 starts. Then, at block 402, frame histogram matrices are reset. At block 403, method 400 computes histogram changes (X) for each zone of the frame or portion thereof. At block 404, method 400 determines whether $X>X^{th}$. If so, the image is considered to be sufficiently dynamic, and control returns to block 401 such that the screen protection mode is not entered into. Otherwise, block 405 determines whether there has been a button press by the user.

At block 405, in case a button press event is detected, control returns to block 401. If the event is not detected, block 406 determines whether a timeout even has occurred. If so, control passes to block 407, which goes to the next screen zone and passes control to block 403. If not, at block 408, method 400 enters a screen protection mode by dimming the OLED display.

Block 409 determines whether an above-threshold frame histogram change or button press has taken place within a period of time (e.g., 15 seconds). If so, block 410 exits the protection mode and lights up the OLED display. If not, block 411 shows a message on the screen indicating the status. At block 412, if there is a histogram change or button press during another time interval (e.g., 4 minutes), again block 410 exits the protection mode.

Otherwise, at block 413, method 400 commands T-con 202 to turn the OLED screen off. At block 414, method 400 waits until there is an above-threshold frame histogram change or a button press event, at which time control returns to block 410 and the OLED again exits protection mode.

To illustrate an example of the foregoing, assume a first frame has 100 pixels or sub-pixels (or any other number of pixels or sub-pixels) with a brightness level of 255. If a second, subsequent frame has 95 pixels or sub-pixels with the same brightness level, and if the threshold value is 5% or less, then movement is detected and the screen protection mode is avoided. Conversely, if the second frame has 96 per pixels or sub-pixels with the same brightness level, and if the threshold value still is 5% or less, then the image may be considered an still image and, after a predetermined amount of time without movement or user input, the OLED may enter the screen protection mode.

In many embodiments, systems and methods described herein may perform detection based upon frame histograms, and not based upon individual sub-pixel and/or sub-pixel-by-sub-pixel comparison. As a result, however, some screen changes may not always be correctly detected. For example, when mouse cursor is moving across a full white screen, there is virtually no FH change from frame to frame. Conversely, some small, perpetual changes (e.g., a digital clock in the OS task bar) can nonetheless introduce "noise," potentially preventing the OLED monitor to enter protection mode.

To address the aforementioned non-detection problem (e.g., lack of sensitivity) and/or the noise problem (e.g., detection of otherwise predictable movement in small areas of the screen), some implementations herein may split the screen into multiple zones or regions.

Figure 5:
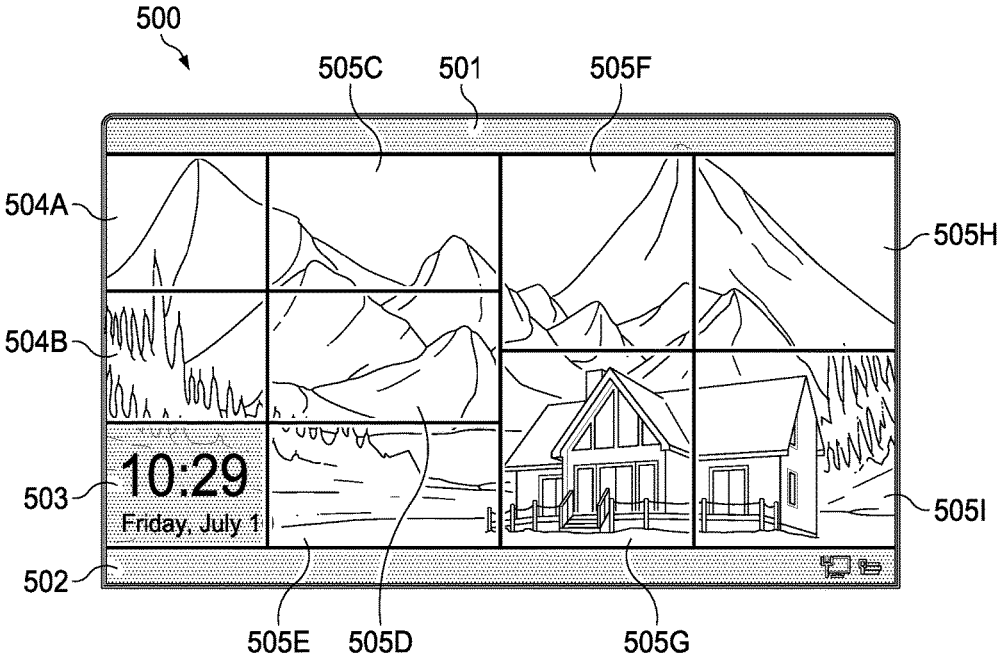
FIG. 5 is a screenshot of an example of detection zones according to some embodiments.

FIG. 5 is a screenshot of an example of detection zones 500 according to some embodiments. In this case, excluded the top and bottom areas 501 and 502 of the OLED screen, respectively, have been excluded from the analysis to avoid expected OS "task bars." Zones 500 also exclude area 503, where, for example, the default WINDOWS home screen clock is located.

Of the remaining areas, zones 500 include nine detection zones 505A-I, which may be analyzed in turn (e.g., by operation of block 407 in FIG. 4). By doing so, the use of zones 500 can increase the detection accuracy greatly. Regardless of the content of a frame, any small change (e.g., mouse cursor moving across the zones) can be detected. This also ensures fast recovery or exit from the screen protection mode.

In some embodiments, more emphasis may be placed on the screen's central area by having more detection zones in the central area and fewer at peripheral areas. Additionally or alternatively, more emphasis may be placed on the screen's central are by scanning the central area zones more often than other, peripheral zones. Additionally or alternatively, a user may customize these various detection zones to suit different software applications or OSs.

In sum, systems and methods described herein may make use of statistical data of each frame instead of comparing every sub-pixel of each frame. In this way we only need to process a small fraction of data from each frame, enabling fast response and no lag in entering and exiting protection mode. In some cases, this solution may split the OLED screen into zones to optimize screen changes detection. By analyzing smaller sections of the screen, changes in localized area can be detected. It can also exit the protection mode with small movements of the mouse cursor. Finally, this solution strategically ignores changes some sections of the screen to avoid areas that may false trigger the algorithm (e.g., ticking clock on the menu bar). This enables the algorithm to have high sensitivity without false triggers.

At least some of the systems and methods described herein do not employ any additional devices (e.g., like IR sensors or camera) to sense a user. This is a relevant factor as such devices take up valuable space in the monitor's bezel, resulting in poor identification. Heat from the OLED panel also makes it very difficult to employ passive IR sensors close to the panel. In addition, this solution is standalone and does not depend on type of PC connected, OS and OS settings (e.g., Energy Saver setting, Screen Saver setting, etc.). It also does not rely on signal between PC and monitor to activate or recover from the protection mode. Finally, this solution has a familiar user experience when dimming and/or turning off the screen, and then recovering. For example, the screen dims after no content changes for a predetermined amount of time, and the screen recovers by moving the mouse or by touching front panel buttons.

It should be understood that various operations described herein may be implemented in software executed by logic or processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An Information Handling System (IHS), comprising:
an Organic Light-Emitting Diode (OLED) screen; and
a controller coupled to the OLED screen, wherein the controller is configured to:
generate at least one current histogram matrix for a current frame;
compare the at least one current histogram matrix against at least one previous histogram matrix generated for a previous frame, wherein the current frame and the previous frame each consists of a subset of pixels smaller than a total number of pixels present in the OLED screen, and wherein the subset of pixels excludes an area of the OLED screen that is subject to change over time in the absence of any user interaction with any input device coupled to the IHS; and
enter a screen protection mode of operation in response to the comparison indicating that the at least one current histogram matrix is different from the at least one previous histogram matrix by an amount equal to or smaller than a threshold.

2. The IHS of claim 1, wherein:
at least one current histogram matrix includes: a first red sub-pixel histogram matrix, a first green sub-pixel histogram matrix, and a first blue sub-pixel histogram matrix; and
at least one previous histogram matrix includes a second red sub-pixel histogram matrix, a second green sub-pixel histogram matrix, and a second blue sub-pixel histogram matrix.

3. The IHS of claim 2, wherein each current and each previous histogram matrix includes, for each given color sub-pixel, a brightness level for the given color sub-pixel, and wherein each of the brightness levels is between 0 and 255.

4. The IHS of claim 1, wherein the threshold amount is selected based upon at least one of: a noise expected during a switch between the current frame and the previous frame, and a sensitivity of detection desired during the switch between the current frame and the previous frame.

5. The IHS of claim 1, wherein the difference between the at least one current histogram matrix and the at least one previous histogram matrix is maintained or decreased for a selected amount of time prior to the entering of the screen protection mode.

6. The IHS of claim 1, wherein the screen protection mode includes: a uniform reduction in brightness of the screen for a first period of time, followed by a warning message displayed on the screen for a second period of time, followed by a turning of the screen black until user interaction with a user input device coupled to the IHS is detected.

7. The IHS of claim 1, wherein the subset of pixels excludes pixels located at a top portion of the OLED screen and pixels located at a bottom portion of the OLED screen.

8. The IHS of claim 1, wherein the subset of pixels includes a plurality of detection regions, each detection region including a plurality of neighboring pixels in the OLED screen.

9. The IHS of claim 8, wherein one or more of the plurality of detection regions include a center of the OLED screen.

10. The IHS of claim 8, wherein one or more of the plurality detection regions are selected by a user.

11. The IHS of claim 8, wherein one or more of the detection regions is subject to the generating and comparing operations more often than another one of the detection regions.

12. A hardware memory device of an Organic Light-Emitting Diode (OLED) screen having program instructions stored thereon that, upon execution by the controller, cause the OLED screen to:
generate at least one current histogram matrix for a current frame;
compare the at least one current histogram matrix against at least one previous histogram matrix generated for a previous frame, wherein the current frame and the previous frame each consists of a subset of pixels smaller than a total number of pixels present in the OLED screen, and wherein the subset of pixels excludes an area of the OLED screen that is subject to change over time in the absence of user interaction with an input device; and
enter a screen protection mode of operation in response to the comparison indicating that the at least one current histogram matrix is different from the at least one previous histogram matrix by an amount equal to or smaller than a threshold.

13. The hardware memory device of claim 12, wherein the at least one current histogram matrix includes a first red sub-pixel histogram matrix, a first green sub-pixel histogram matrix, and a first blue sub-pixel histogram matrix, wherein the at least one previous histogram matrix includes a second red sub-pixel histogram matrix, a second green sub-pixel histogram matrix, and a second blue sub-pixel histogram matrix, and wherein each current and each previous histogram matrix includes, for each given color sub-pixel, a brightness level for the given color sub-pixel.

14. The hardware memory device of claim 12, wherein the threshold amount is selected based upon at least one of: a noise expected during a switch between the current frame and the previous frame, and a sensitivity of detection desired during the switch between the current frame and the previous frame.

15. The hardware memory device of claim 12, wherein the difference between the at least one current histogram matrix and the at least one previous histogram matrix is maintained or decreased for a selected amount of time prior to the entering of the screen protection mode, wherein the screen protection mode includes: a uniform reduction in brightness of the screen for a first period of time, followed by a warning message displayed on the screen for a second period of time, followed by a turning of the screen black until user interaction with a user input device coupled to the IHS is detected.

16. The hardware memory device of claim 12, wherein the subset of pixels excludes pixels located at a top portion of the OLED screen and pixels located at a bottom portion of the OLED screen.

17. A computer-implemented method, comprising:
generating at least one current histogram matrix for a current frame displayed by and Organic Light-Emitting Diode (OLED) screen;
comparing the at least one current histogram matrix against at least one previous histogram matrix generated for a previous frame, wherein the current frame and the previous frame each consists of a subset of pixels smaller than a total number of pixels present in the OLED screen, wherein the subset of pixels comprises a plurality of detection regions having a plurality of neighboring pixels in the OLED screen, and wherein one or more of the detection regions is subject to the generating and comparing operations more often than another one of the detection regions; and entering a screen protection mode of operation in response to the comparison indicating that the at least one current histogram matrix is different from the at least one previous histogram matrix by an amount equal to or smaller than a threshold, wherein each current and each previous histogram matrix includes, for each given color sub-pixel of the OLED screen, a brightness level for the given color sub-pixel.

18. The computer-implemented method of claim 17, wherein the difference between the at least one current histogram matrix and the at least one previous histogram matrix is maintained or decreased for a selected amount of time prior to the entering of the screen protection mode, wherein the current frame and the previous frame each consist of a subset of pixels smaller than a total number of pixels present in the OLED screen.

* * * * *